US008118015B2

(12) United States Patent
Tran

(10) Patent No.: US 8,118,015 B2
(45) Date of Patent: Feb. 21, 2012

(54) BOTTOM FEED MAGAZINE OF PAINTBALL GUN

(75) Inventor: Khanh Tran, San Jose, CA (US)

(73) Assignee: Real Action Paintball Inc., San Jose, CA (US)

( * ) Notice: Subject to any disclaimer, the term of this patent is extended or adjusted under 35 U.S.C. 154(b) by 281 days.

(21) Appl. No.: 12/503,072

(22) Filed: Jul. 15, 2009

(65) Prior Publication Data

US 2011/0011386 A1 Jan. 20, 2011

(51) Int. Cl.
*F41B 11/02* (2006.01)

(52) U.S. Cl. ..... 124/51.1; 124/73

(58) Field of Classification Search ..... 124/48, 124/49, 51.1, 73, 74
See application file for complete search history.

(56) References Cited

U.S. PATENT DOCUMENTS

| | | | | |
|---|---|---|---|---|
| 5,954,042 | A * | 9/1999 | Harvey | 124/51.1 |
| 6,957,645 | B1 * | 10/2005 | Cross | 124/51.1 |
| 7,270,121 | B2 * | 9/2007 | Lubben | 124/51.1 |
| 7,322,348 | B2 * | 1/2008 | Chen et al. | 124/51.1 |
| 7,640,924 | B2 * | 1/2010 | Cherepanov | 124/51.1 |
| 2006/0054151 | A1 * | 3/2006 | Christopher et al. | 124/48 |
| 2007/0017495 | A1 * | 1/2007 | Andresen | 124/51.1 |
| 2009/0025700 | A1 * | 1/2009 | Andresen | 124/51.1 |

* cited by examiner

*Primary Examiner* — John Ricci

(57) ABSTRACT

A bottom feed magazine of a paintball gun includes a housing for storing a plurality of paintballs. A circular tray is mounted to the housing. A hub is rotatable about a shaft within the circular tray at a center thereof. The circular tray and the hub together define an annular channel for receiving paintballs dropped therein from the housing. A plurality of arms is provided on the hub for driving the paintballs along the channel. A tube has an inlet end extending into the channel and an outlet end extending generally upwards to a top wall of the housing. When the central hub rotates, the paintballs in the channel are driven along the channel, into the inlet end and pushed up along the tube towards the outlet end.

17 Claims, 4 Drawing Sheets

BOTTOM FEED MAGAZINE OF PAINTBALL GUN

FIELD OF PATENT APPLICATION

The present patent application relates to a bottom feed magazine of a paintball gun.

BACKGROUND

Paintballs are usually fed into a paintball gun by means of a bulky bucket-like hopper that is attached to the top of the main body of the paintball gun. However, this top feed bulky hopper disrupts the player's view and easily gives away the position of the player by having the bulky hopper sticking out on top of the paintball gun during the game.

To resolve the above-mentioned problem, spring-loaded magazines have been designed to feed paintballs from the bottom of the paintball gun. However, these bottom feed spring-loaded magazines are limited in capacity in holding paintballs. Normally, a spring-loaded magazine can only hold up to about 20-30 paintballs. Furthermore, the spring load constantly puts pressure on the paintballs in the magazine causing them to deform and jam.

The above description of the background is provided to aid in understanding a bottom feed magazine of a paintball gun, but is not admitted to describe or constitute pertinent prior art to the bottom feed magazine of a paintball gun disclosed in the present patent application.

SUMMARY

A magazine of a paintball gun is provided. The magazine includes a housing for storing a plurality of paintballs, a channel for receiving the paintballs dropped therein from the housing, a plurality of arms for driving the paintballs along the channel, and a tube having an inlet end extending into the channel and an outlet end extending generally upwards to a top wall of the housing. The paintballs dropped into the channel are driven along the channel, pushed into the inlet end and up along the tube towards the outlet end by the arms.

The channel may include an annular channel defined by a circular tray mounted to the housing and a hub rotatable within the circular tray about a central shaft fixed to the hub.

The plurality of arms may be provided on the hub and extends radially outwards to define a plurality of slots for receiving the paintballs.

The housing may include a partition wall dividing the housing into an upper compartment for storing the paintballs and a lower compartment in which the tray and the hub are mounted, and the partition wall may include an opening through which the paintballs drop from the upper compartment into the channel in the lower compartment. The partition wall may include a slanted portion for directing the paintballs in the upper compartment to roll towards the opening of the partition wall.

The tube may include a generally horizontal section, a generally vertical section, and an upturning curved section extending between the horizontal and vertical sections.

The housing may sized and shaped for receiving up to 100 or more paintballs.

The bottom feed magazine may further include a coupler connected to the outlet end of the tube for detachably coupling the bottom feed magazine to a firing chamber of the paintball gun.

The bottom feed magazine may further include a handle fixedly coupled to an end of the shaft of the central hub extending outside the housing.

BRIEF DESCRIPTION OF THE DRAWINGS

Specific embodiments of the bottom feed magazine of a paintball gun disclosed in the present patent application will now be described by way of example with reference to the accompanying drawings wherein.

DETAILED DESCRIPTION

Figure 1:
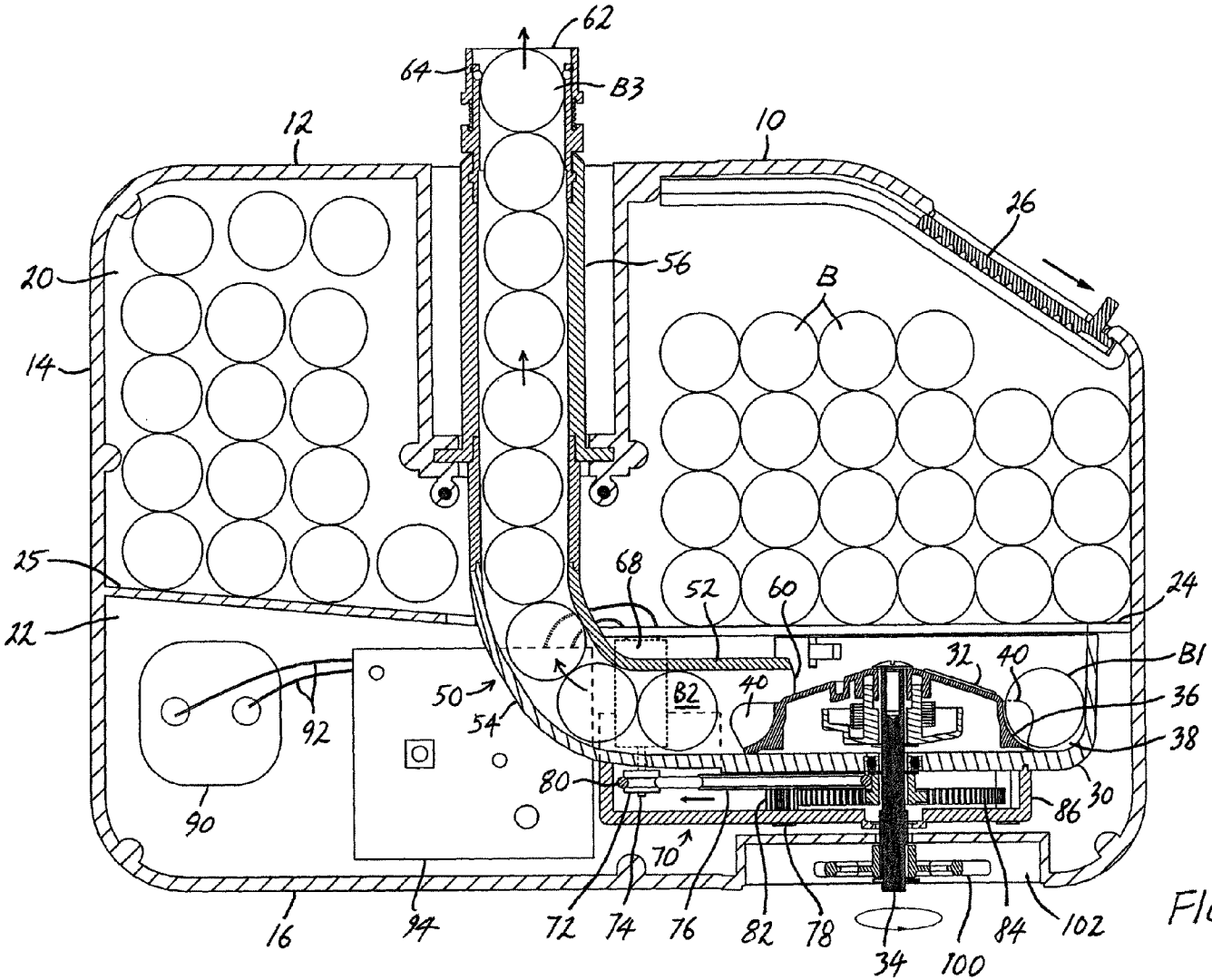
FIG. 1 is a cross sectional view of the bottom feed box magazine of a paintball gun according to an embodiment disclosed in the present patent application.

Reference will now be made in detail to a preferred embodiment of the bottom feed magazine of a paintball gun disclosed in the present patent application, examples of which are also provided in the following description. Exemplary embodiments of the bottom feed box magazine of a paintball gun disclosed in the present patent application are described in detail, although it will be apparent to those skilled in the relevant art that some features that are not particularly important to an understanding of the bottom feed magazine of a paintball gun may not be shown for the sake of clarity.

Furthermore, it should be understood that the bottom feed magazine of a paintball gun disclosed in the present patent application is not limited to the precise embodiments described below and that various changes and modifications thereof may be effected by one skilled in the art without departing from the spirit or scope of the claims.

Certain terminology is used in the following description for convenience only and is not limiting. The word "left", "right", "upper", "lower", "top", or "bottom" designates directions in the drawings to which reference is made. The terminology includes the words noted above as well as derivatives thereof and words of similar import.

It should be noted that throughout the specification and claims herein, when one element is said to be "coupled" or "connected" to another, this does not necessarily mean that one element is fastened, secured, or otherwise attached to another element. Instead, the term "coupled" or "connected" means that one element is either connected directly or indirectly to another element, or is in mechanical or electrical communication with another element.

FIG. 1 is a cross sectional view of the bottom feed magazine of a paintball gun according to an embodiment disclosed in the present patent application.

Figure 4:
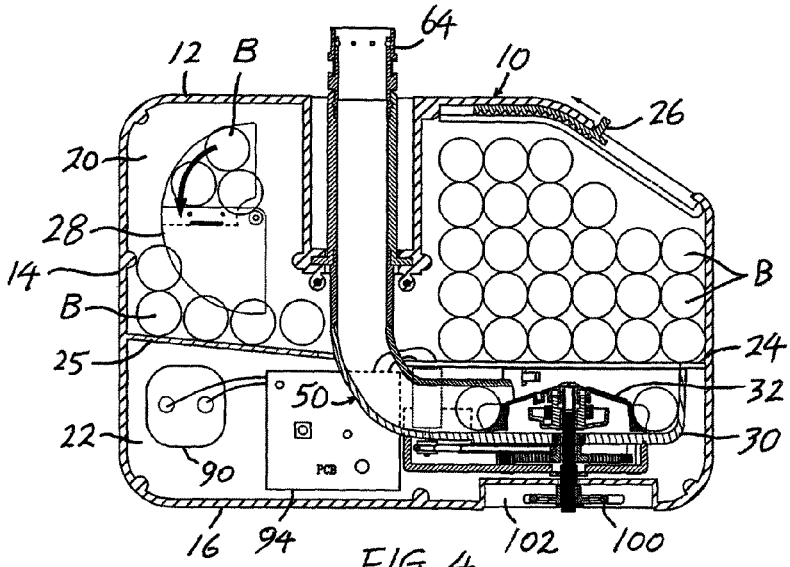
FIG. 4 is a cross sectional view of the bottom feed box magazine showing a slide door and a side door in an open position.
Figure 5:
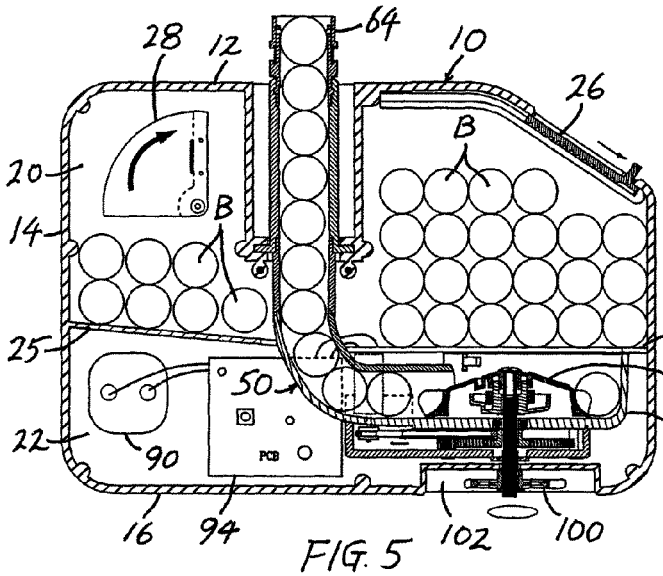
FIG. 5 is a cross sectional view of the bottom feed box magazine showing the slide door and the side door in a closed position.

The bottom feed magazine includes a housing 10. According to the illustrated embodiment, the housing 10 may be generally rectangular box-shaped having a top wall 12, a sidewall 14, and a bottom wall 16. The housing 10 may include an upper compartment 20 and a lower compartment 22, and a petition wall 24 dividing the upper and lower compartments 20, 22. The upper compartment 20 is adapted to receive and store therein a plurality of paintballs B. The upper compartment 20 may have a size sufficient to receive up to 100 or more paintballs B. A slide door 26 can be slidably mounted on the top wall 12 of the housing 10 to cover an upper opening provided on the upper compartment 20 of the housing 10. An additional side door 28 may be provided on the sidewall 14 of the housing 10, as shown in FIGS. 4 and 5.

The housing 10 may be made of plastic or any other suitable material. The housing 10 may be made of transparent material so that a player can see the number of paintballs B remaining in the magazine during the game.

Although it has been shown and described that the magazine is generally rectangular box-shaped, it is appreciated that the magazine can be in any other appropriate shape and size. For example, the magazine can be generally cylindrical in shape.

Figure 3:
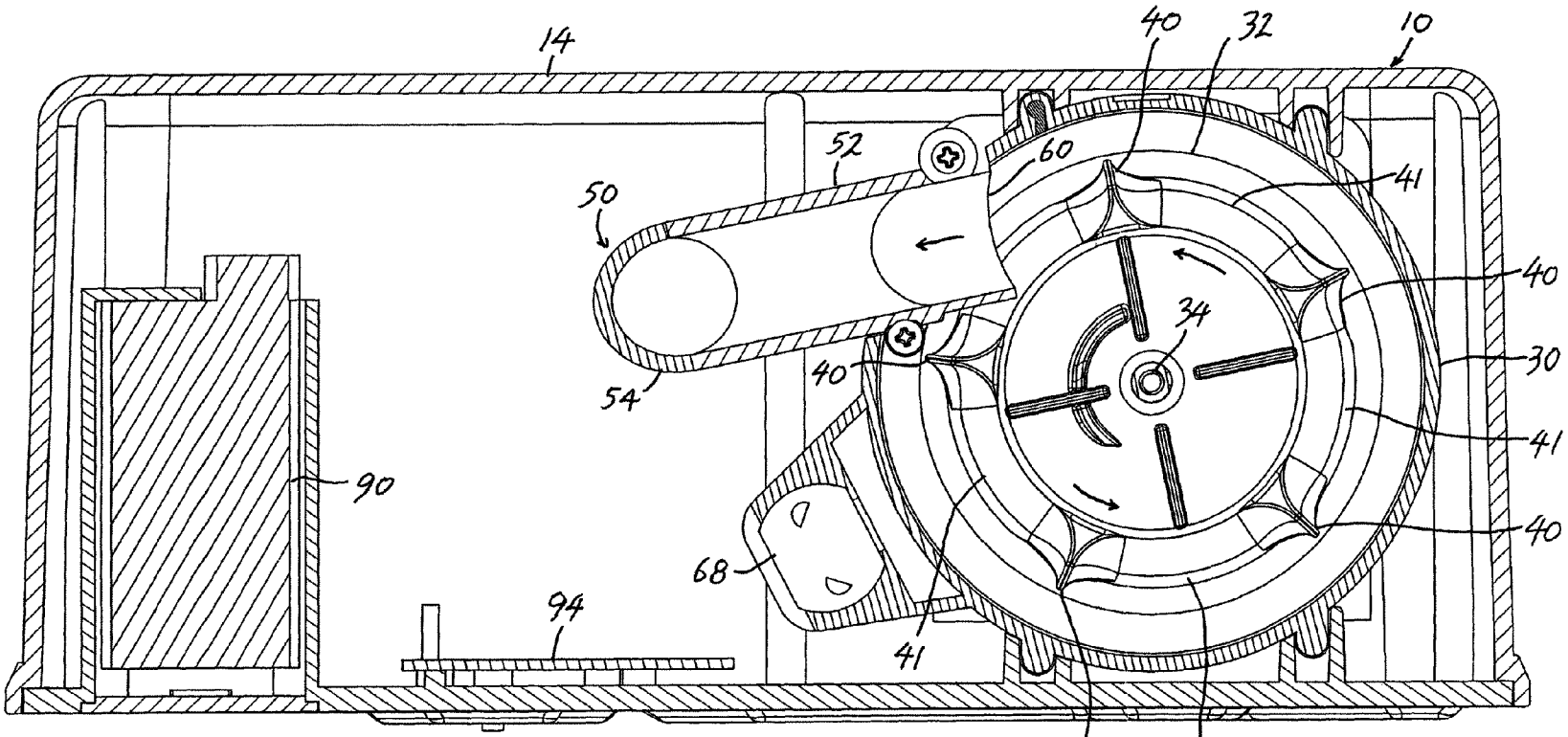
FIG. 3 is a horizontal cross sectional view of the bottom feed box magazine of the paintball gun.

The lower compartment 22 includes a circular tray 30 that may be mounted to a lower surface of the partition wall 24. A circular central wheel or hub 32 can be fixedly mounted on a shaft 34 rotatably mounted at the center of the tray 30. The central hub 32 may include a circular sidewall 36 with a surface generally conforming in shape with the outer surface of the paintballs B. The circular tray 30 and the central hub 32 together define an annular recess or channel 38 along which paintballs B1 move. The central hub 38 may include a plurality of paintball-driving protrusions or arms 40 extending radially therefrom for driving paintballs B1 along the annular channel 38. Two adjacent paintball-driving arms 40 define a slot 41 for receiving therein a paintball, as best illustrated in FIG. 3.

Although it has been shown and described that the paintballs are received in the annular channel defined by the circular tray and the central hub, it is understood by one skilled in the art that the paintballs can be received in any suitable form and shape of channel or recess formed separately from or integrally with the housing.

Figure 6:
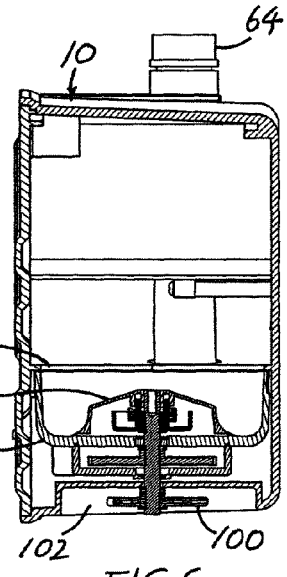
FIG. 6 is another cross sectional view of the bottom feed box magazine.

The bottom feed magazine may include a paintball-feeding tube 50 having an inlet end 60 extending into the annular channel 38 and an outlet end 62 extending generally upwards to the top wall 12 of the housing 10. According to the illustrated embodiment, the paintball-feeding tube 50 is generally J-shaped. The paintball-feeding tube 50 may include a generally horizontal section 52, an upturning curved section 54, and a generally vertical section 56. The inlet end 60 is provided on the horizontal section. The outlet end 62 is provided on the vertical section 56. The outlet end 62 may include a coupler 64 for detachably coupling the bottom feed magazine to a firing chamber of the paintball gun. The paintball-feeding tube 50 can be disposed generally at a center of the housing 10, as illustrated in FIGS. 4-6. This allows the housing 10 to be mounted in a steady and balanced position when the box magazine is attached to the bottom of the paintball gun.

An electric motor 68 and a drive mechanism, generally designated by reference numeral 70, can be employed to drive the shaft 34 to rotate. The drive mechanism 70 may include a first belt-pulley 72 fixedly mounted on a motor shaft 74, a second belt-pulley 76 fixedly mounted on shaft 78, and a belt 80 looping over the first and second belt-pulley 72, 76 for driving them to rotate simultaneously. The drive mechanism 70 may further include a pinion gear 82 fixedly mounted on the shaft 78, and a gear 84 fixedly mounted on the shaft 34 and engaged with the pinion gear 82. The first and second belt-pulleys 72, 76 and the two gears 82, 84 can be accommodated within a pulley and gear box 86.

Although it has been shown and described that the drive mechanism 70 contains a combination of belt-pulleys and gears, it is understood by one skilled in the art that the drive mechanism can be of any other suitable drive mechanism so long as it can translate the rotating motion of the motor shaft to the rotating motion of the shaft that drives the central hub around. For example, the drive mechanism may only contain a gear train having a plurality of meshing gears, or may only contain a plurality of bell pulleys with at least one belt looping over the bell pulleys.

A power source such as a battery 90 may be provided to supply power to the motor 68 through electric wires 92 that are electrically connected to a printed circuit board 94. A switch may be provided to turn the motor 68 on and off in a conventional manner. When the motor 68 is activated, the motor shaft 74 rotates and drives the first and second belt-pulleys 72, 76, the two gears 82, 84, the shaft 34, and in turn the central hub 32 to rotate.

When the central hub 32 rotates, the paintball-driving arms 40 push the paintballs B1, which are dropped into the annular channel 38 from the upper compartment 20, to move along the annular channel 38 and eventually into the inlet end 60 of the paintball-feeding tube 50. It is appreciated that the inlet end 60 extends into the annular channel 38 to a certain distance sufficient to take up the paintballs being driven by the arms 40 and yet clear from the moving arms 40. When a paintball B2 has been driven into inlet end 60 of the paintball-feeding tube 50, the paintball B2 pushes the paintballs already inside the paintball-feeding tube 50 along the horizontal section 52, up into the upturning and vertical sections 54, 56 of the paintball-feeding tube 50, as shown by the arrows. Eventually, a paintball B3 originally located at an uppermost position of the vertical section 56 can be pushed into the firing chamber of the paintball gun ready for firing.

A handle 100 may be provided within a recess 102 formed on the bottom wall 16 of the housing 10. The handle 100 may be fixedly mounted at a lower end of the shaft 34 extending outside the housing 10. The handle 100 may be employed to manually drive the central hub 32 to rotate when necessary.

Figure 2:
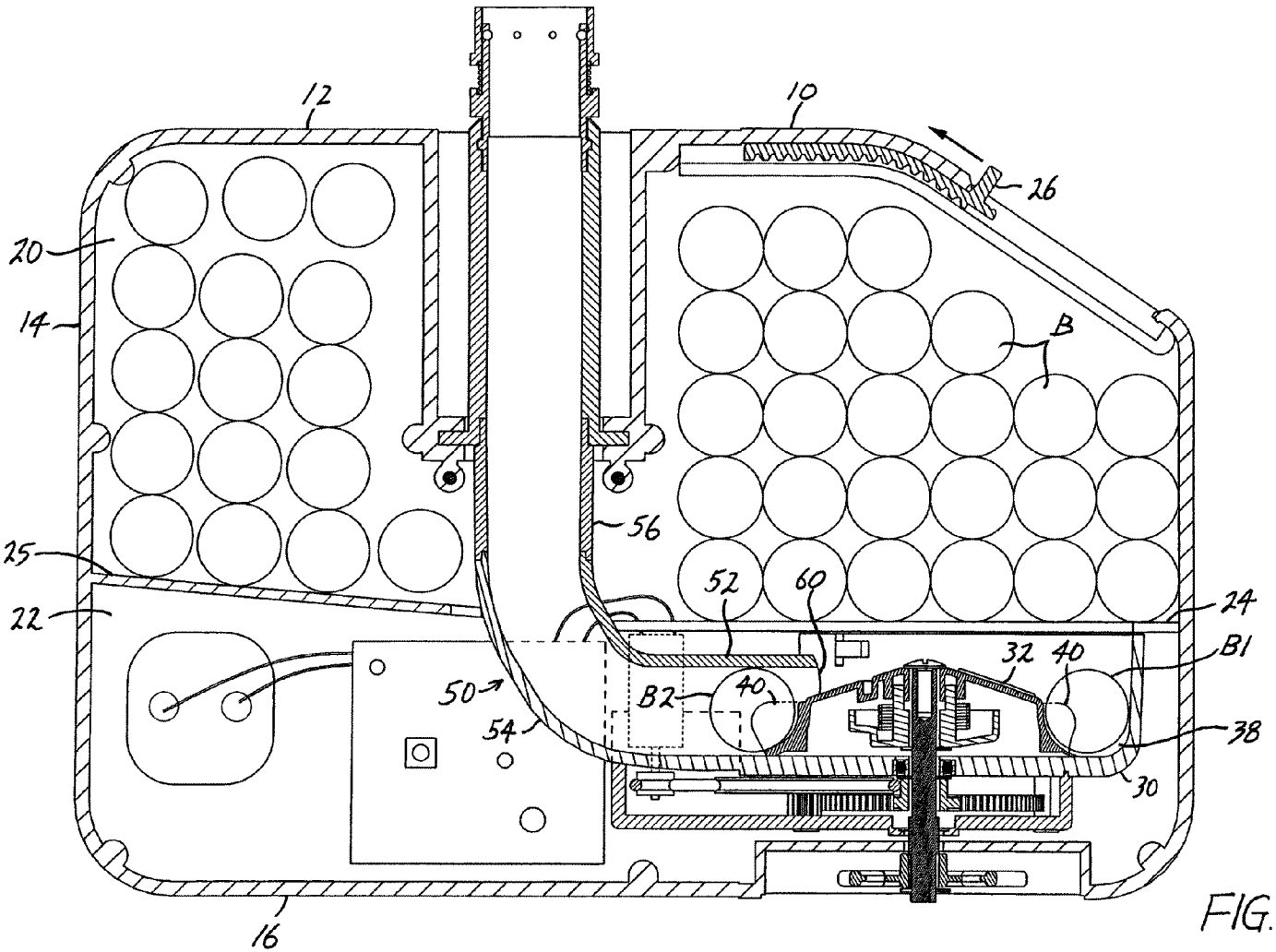
FIG. 2 is a similar cross sectional view of the bottom feed box magazine of a paintball gun in FIG. 1 showing the initial loading of paintballs in the box magazine.

FIG. 2 is a similar cross sectional view of the bottom feed magazine of a paintball gun in FIG. 1 showing the initial loading of paintballs B in the box magazine. A player can slide the door 26 open and load up to 100 or more paintballs B into the upper compartment 20 of the housing 10. The petition wall 24 may have a slanted portion 25 for directing the paintballs B to roll by gravity from one side to the other side of the housing 10 where the tray 30 is located. Paintballs B drop into the annular channels 38 of the tray 30 through an opening of the partition wall 24. Paintball B1 at one side of the annular channel 38 can be driven by the arms 40 to the other side. Paintball B2 at the other side of the annular channel 38 can then be pushed into the inlet end 60 of the paintball-feeding tube 50 by the arms 40. The player can also load the paintballs B into the upper compartment 20 through the side door 28 provided on the sidewall 14, as depicted in FIGS. 4 and 5.

While the bottom feed magazine of a paintball gun disclosed in the present patent application has been shown and described with particular references to a number of preferred embodiments thereof, it should be noted that various other changes or modifications may be made without departing from the scope of the appending claims.

What is claimed is:

1. A bottom feed magazine of a paintball gun, the bottom feed magazine comprising: a housing for storing a plurality of paintballs; a circular tray mounted to the housing; a hub rotatable within the circular tray about a central shaft fixed to the hub, the circular tray and the hub together defining an annular channel for receiving the paintballs dropped therein from the housing; a plurality of arms provided on the hub for driving the paintballs along the channel; and a tube comprising an inlet end extending into the channel and an outlet end extending generally upwards to a top wall of the housing; wherein the paintballs dropped into the channel are driven along the channel, pushed into the inlet end and up along the tube towards the outlet end as the hub rotates; wherein the tube comprises a generally horizontal section, a generally vertical section, and an upturning curved section extending between the horizontal and vertical sections.

2. The bottom feed magazine as claimed in claim 1, wherein the plurality of arms extends radially outwards to define a plurality of slots for receiving the paintballs.

3. The bottom feed magazine as claimed in claim 1, wherein the tube is generally J-shaped.

4. The bottom feed magazine as claimed in claim 1, wherein the housing comprises a partition wall dividing the housing into an upper compartment for storing the paintballs and a lower compartment in which the tray and the hub are mounted, and the partition wall comprises an opening through which the paintballs drop from the upper compartment into the channel in the lower compartment.

5. The bottom feed magazine as claimed in claim 4, wherein the partition wall comprises a slanted portion for directing the paintballs in the upper compartment to roll towards the opening of the partition wall.

6. The bottom feed magazine as claimed in claim 1, wherein the housing comprises a slide door.

7. The bottom feed magazine as claimed in claim 1, wherein the housing is sized for receiving up to 100 or more paintballs.

8. The bottom feed magazine as claimed in claim 1, further comprising a coupler connected to the outlet end of the tube for detachably coupling the bottom feed magazine to a firing chamber of the paintball gun.

9. The bottom feed magazine as claimed in claim 1, further comprising a handle fixedly coupled to an end of the shaft of the central hub extending outside the housing.

10. A magazine of a paintball gun, the magazine comprising: a housing for storing a plurality of paintballs; a channel for receiving the paintballs dropped therein from the housing; a plurality of arms for driving the paintballs along the channel; and a tube comprising an inlet end extending into the channel and an outlet end extending generally upwards to a top wall of the housing; wherein the paintballs dropped into the channel are driven along the channel, pushed into the inlet end and up along the tube towards the outlet end by the arms; wherein the channel comprises an annular channel defined by a circular tray mounted to the housing and a hub rotatable within the circular tray about a central shaft fixed to the hub; wherein the housing comprises a partition wall dividing the housing into an upper compartment for storing the paintballs and a lower compartment in which the tray and the hub are mounted, and the partition wall comprises an opening through which the paintballs drop from the upper compartment into the channel in the lower compartment.

11. The bottom feed magazine as claimed in claim 10, wherein the plurality of arms is provided on the hub and extends radially outwards to define a plurality of slots for receiving the paintballs.

12. The bottom feed magazine as claimed in claim 10, wherein the partition wall comprises a slanted portion for directing the paintballs in the upper compartment to roll towards the opening of the partition wall.

13. The bottom feed magazine as claimed in claim 10, wherein the tube comprises a generally horizontal section, a generally vertical section, and an upturning curved section extending between the horizontal and vertical sections.

14. The bottom feed magazine as claimed in claim 10, wherein the housing is sized and shaped for receiving up to 100 or more paintballs.

15. The bottom feed magazine as claimed in claim 10, further comprising a coupler connected to the outlet end of the tube for detachably coupling the bottom feed magazine to a firing chamber of the paintball gun.

16. The bottom feed magazine as claimed in claim 10, further comprising a handle fixedly coupled to an end of the shaft of the central hub extending outside the housing.

17. A paintball gun comprising a bottom feed magazine, the bottom feed magazine comprising: a housing for storing a plurality of paintballs; a circular tray mounted to the housing; a hub rotatable within the circular tray about a central shaft fixed to the hub, the circular tray and the hub together defining an annular channel for receiving paintballs dropped therein from the housing; a plurality of arms provided on the hub for driving the paintballs along the channel, the plurality of arms extending radially outwards to define a plurality of slots for receiving the paintballs; a tube comprising an inlet end extending into the channel and an outlet end extending generally upwards to a top wall of the housing; and a motor for rotating the central shaft; wherein the paintballs dropped into the channel are driven along the channel, pushed into the inlet end and up along the tube towards the outlet end as the hub rotates; wherein the tube is generally J-shaped.

* * * * *